US005157910A

United States Patent [19]

Artzt et al.

[11] Patent Number: 5,157,910

[45] Date of Patent: Oct. 27, 1992

[54] PROCESS AND DEVICE FOR THE AIR-CONDITIONING OF SPINNING MATERIAL

[75] Inventors: Peter Artzt; Gerhard Egbers, both of Reutlingen; Heinrich Preininger, Filderstadt, all of Fed. Rep. of Germany

[73] Assignee: Schubert & Salzer Maschinenfabrik Aktiengesellschaft, Ingolstadt, Fed. Rep. of Germany

[21] Appl. No.: 789,419

[22] Filed: Nov. 4, 1991

Related U.S. Application Data

[63] Continuation of Ser. No. 537,035, Jun. 12, 1990, abandoned.

[30] Foreign Application Priority Data

Jun. 13, 1989 [DE] Fed. Rep. of Germany ..... 3919284

[51] Int. Cl.[5] ..... D01H 13/30; D01B 3/04

[52] U.S. Cl. ..... 57/308; 19/66 R

[58] Field of Search ..... 57/281, 308, 400, 409, 57/411, 415, 408; 19/159 R, 0.27, 66 R; 68/5 C; 39/23

[56] References Cited

U.S. PATENT DOCUMENTS

| | | | |
|---|---|---|---|
| 2,425,578 | 8/1947 | Thoma et al. | 34/23 X |
| 3,073,106 | 1/1963 | Tsuzuki | 57/308 |
| 3,604,124 | 9/1971 | Leeds et al. | 34/23 |
| 3,665,070 | 5/1972 | Knodo et al. | 34/23 X |
| 4,183,233 | 1/1980 | Brown | 68/5 C |
| 4,357,793 | 11/1982 | Gasser et al. | 57/308 |
| 4,523,441 | 6/1985 | Braybrook et al. | 57/308 X |
| 4,857,090 | 8/1989 | Hartness | 62/91 |

*Primary Examiner*—Daniel P. Stodola
*Assistant Examiner*—John Rollins
*Attorney, Agent, or Firm*—Dority & Manning

[57] ABSTRACT

A process and a device for the air-conditioning of spinning material located in a container. The spinning material is air-conditioned for processing in a spinning machine which is essentially surrounded by any room climate. The spinning material is exposed in the container to a climate which is independent of the room climate. This causes, at least, the spinning material to be taken next out of the container to be air-conditioned in such manner that it is in an optimal climatic state for such further processing. Outlet openings of at least one air-conditioning duct or an air-conditioning plant are located on the container so that an air-conditioned fluid flows out of the outlet openings on at least the spinning material to be taken out next and the spinning material is in an optimal climatic state for further processing as it is then processed further.

5 Claims, 4 Drawing Sheets

PROCESS AND DEVICE FOR THE AIR-CONDITIONING OF SPINNING MATERIAL

This is a continuation of application Ser. No. 07/537,035, filed Jun. 12, 1990, which was abandoned upon the filing hereof.

BACKGROUND OF THE INVENTION

The instant invention relates to a process and to a device for the air-conditioning of spinning materials located in a container and subject to being processed further in a spinning machine surrounded by the room climate.

It is known that the climatic conditions of spinning material directly influence the quality to be achieved in further processing of the spinning material, e.g. that it may result in the distortion of a fiber sliver. It is, therefore, customary for spinning halls to be provided with a constant room climate. Constant room climate means a spinning climate that depends directly on the room climate and a climate of the spinning material in keeping with the room climate. The disadvantage in this type of air-conditioning is the high expenditure of energy required in order to air-condition the entire spinning hall.

Furthermore, a known procedure for air-conditioning fiber sliver and drawing equipment in a ring spinning machine to distort the fiber sliver is known from U.S. Pat. No. 3,-73,106. Air-conditioning in the known device takes place in an air-conditioned housing mounted on the ring spinning machine. The housing is divided into an upper and a lower section, each being closed by doors. In this design the problems become clear. Simultaneous air-conditioning of a great number of fiber slivers and the drawing equipment requires frequent opening of the air-conditioned housing to replace fiber slivers or to clean the drawing equipment, causing a disturbance of the optimal climate. Furthermore, such doors are a hindrance in the automation of the spinning process, which is becoming more and more important.

SUMMARY OF THE INVENTION

It is, therefore, the object of the instant invention to provide optimal air-conditioning of the spinning material while keeping the required expenditures for air-conditioning as low as possible, while no interference with automation of further processing is permitted.

If, for further processing on a spinning machine, the spinning material stored in a container is exposed to a climate that is independent of the room climate surrounding the spinning machine, the advantages with respect to the quality of the product to be produced as well as with respect to the energy expenditure needed for air-conditioning are achieved. Air-conditioning exclusively of the spinning material which is to be taken next from the container makes it possible to keep the volume of fluid to be air-conditioned, and surrounding the spinning material, very low. Furthermore, this makes it possible to air-condition the spinning material to achieve optimal climatic conditions without interference by the room climate. Due to the fact - that only the spinning material and not the wider surroundings, as well as the containers, must be air-conditioned, very precise adjustment of the best climate for further processing of the spinning material is made possible. Any material with a known water absorption capacity can be used as the spinning material. In this way, it is possible for the running behavior and the yarn quality to be positively influenced by the climate. Different climates distinguish themselves from each other through their temperature and humidity. A spinning material, which is climatically different from the optimal climate, asymptotically and gradually acquires the surrounding optimal climate as a function of time. This means that a certain amount of time is required for the optimal air-conditioning of a spinning material. Especially with modern spinning machines, in which the processing speed is ever increasing, it is, therefore, necessary for the spinning material to be processed to be subjected in time to optimal climate. Only when the optimal climate is in contact with the spinning material for a sufficiently long time is a sufficient humidity and temperature exchange possible. After a sufficient period of time in which the spinning material is surrounded by the optimal climate, the spinning material and the fluid are in a state of equilibrium. If the fluid has already reached an optimal climatic value it is important that it be maintained essentially constantly at that value so that the spinning material may be able to adjust itself to that value. This occurs preferably through the continuous exchange of the fluid which gradually deviates from the optimal state against a fluid which has the optimal climate.

If the container containing the spinning material is traversed by an optimally air-conditioned fluid, the entire spinning material is gradually brought to the optimal state. In that case, the fluid flows along the layers of the material and, subsequently, leaves the container. Open layers of material acquire the optimal state more rapidly here than the layers of spinning material which are under cover. If the spinning material is taken from open layers for further processing, this spinning material is in the optimal climatic state and, upon being taken out, uncovers the following layers of spinning material which had been under cover until then. These new layers are again contacted by the optimally air-conditioned fluid and an equilibrium between spinning material and fluid is again achieved.

If the fluid flows through the containers in the direction in which the spinning material is taken out, this ensures removal of the fluid from the container. If the fluid flows through the container in a direction opposite to the direction in which the spinning material is taken out, this results in the advantage that the spinning material which is taken out of the container next is subjected to the optimally air-conditioned fluid. The fluid which comes into contact with the spinning material to be taken out next is thus not altered by the air-conditioning of other layers of the spinning material which are to be taken out only later.

The flow speed of the fluid is selected advantageously as a function of the speed at which the spinning material is taken out of the container. This yields the advantage that the transition from the original climate of the spinning material to the optimal climate of the fluid occurs more rapidly when the spinning material is rapidly taken out of the container.

If the renewal speed of the fluid in the container is adjusted as a function of the speed at which the spinning material is taken out and/or of the difference between spinning material climate and optimal climate of the fluid, this ensures that the spinning material always comes into contact with optimally air-conditioned fluid. This is especially important when the spinning material is taken out at high speed, as air-conditioning of the spinning material must be effected rapidly in that case. If the climates of spinning material and fluid are very different from each other, i.e. if the spinning material must undergo great temperature and/or humidity changes, it is advantageous for the fluid to be maintained in an optimal state through a high renewal rate.

The process described can be carried out in particular by means of a device in which outlet openings of at least one air-conditioning duct of an air-conditioning unit are provided on the container in such manner that air-conditioned fluid flowing out of the outlet openings acts, at least, upon the spinning material to be taken out next. The spinning material is influenced in such manner that it is in an optimal climatic state during its further processing which follows the air-conditioning. The fact that the outlet openings of the air-conditioning duct are directed directly onto the spinning material and are located in the immediate proximity of the spinning material ensures that the spinning material is air-conditioned in an advantageous manner, with a small volume of fluid having to be maintained in an optimal climatic state. The spinning material is always in an optimally air-conditioned environment. This device functions most efficiently when the outlet openings of the air-conditioning channel are placed so that the air-conditioned fluid acts upon the uncovered layers of the spinning material in the container. At the same time the spinning material to be processed next acquires a balanced humidity corresponding to the air-conditioned fluid.

If the container is closed by means of a cover in such manner that it prevents the resistance-free escape of the fluid from the container, this results, on the one hand, in the advantage that the fluid is able to act for a long time upon the spinning material without having to be renewed. On the other hand, the cover ensures that flying particles and dirt do not fall from the environment of the spinning machine on the upper layers of the spinning material and, thus, adversely affect its running behavior during further processing. Air-conditioned fluid essentially fills the volume between the uppermost layer of the spinning material and the cover of the container. This makes it possible to reduce the fluid to be air-conditioned to a small volume.

If the cover is provided on the container, advantages in transporting the containers to the spinning machine are achieved. The cover protects the spinning material from dirt and from changes of the climate proper to the spinning material. It is, furthermore, possible for the spinning material to be already prepared for removal from the container. If the spinning material is a fiber sliver, for example, it can be prepared away from the spinning machine by being led through the cover, and insertion into the spinning machine is facilitated.

If the cover is provided on the spinning machine itself, economic advantages result because only as many covers are needed in a spinning plant as there are processing stations.

If the openings are provided in the cover fore the removal of the spinning material and for the escape of the fluid, it is advantageous to provide for the fluid to escape essentially through different openings than the spinning material. This makes it possible to achieve non-damaging removal of the spinning material from the container, as a rising of fibers in the spinning material by the fluid streaming alongside it as it is removed from the container is thus avoided. If the size of the openings is adjustable, the fluid stream, on the one hand, and the non-damaging removal of the fiber sliver or the threading of the fiber sliver into the removal opening are made possible. Adjustment of the renewal rate of the fluid is especially made possible by regulating the air stream.

If the container is connected to a central air-conditioning duct on the spinning machine, the total volume of the fluid required to be air-conditioned on the spinning machine is reduced. All the containers containing spinning material of same type or followed by identical processing of the same type can be supplied from one air-conditioning plant. If the central air-conditioning duct is provided for a double-sided spinning machine it supplies both sides of the spinning machine in that the containers can be connected on both sides of the spinning machine in accordance with the division of processing stations.

If the container is a supply can for fiber sliver and if the air-conditioned fluid flows through the supply can's air spaced, pre-air-conditioning of the lower layers of the spinning material is achieved in addition to the air-conditioning of the upper layers of thc spinning material. The configuration of the supply can is here not limited only to round cans, but can also be of oval supply cans, for instance. If air-conditioning is effected in one direction of fiber sliver removal it is advantageous t provide openings in the can tray on which the fiber sliver is stored, through which the fluid enters the air spaces of the stored fiber sliver. With a sliver supply of approximately 3 cm/sec the upper 3 to 5 layers of the fiber sliver are subjected for at least 20 minutes to the air-conditioned fluid. This is sufficient to air-condition the fiber material appropriately before it runs into the spinning unit. The optimal humidity and temperature of the fiber material can thus be maintained.

In an advantageous embodiment, the container is given a form which closely encloses the spinning material. It should be noted that at least the spinning material to be removed next from the container is stored in said container in free-laying layers and the fluid can flow around it.

The process and the device are thus suitable for all spinning material which is removed so slowly from the container that an air-conditioned fluid is able to act for a sufficiently long time upon the spinning material and where as large a surface as possible can be exposed to the fluid.

BRIEF DESCRIPTION OF THE DRAWINGS

The invention shall be described hereinbelow in further detail through examples of embodiments, shown in the drawings, in which.

DETAILED DESCRIPTION OF THE INVENTION

Figure 1:
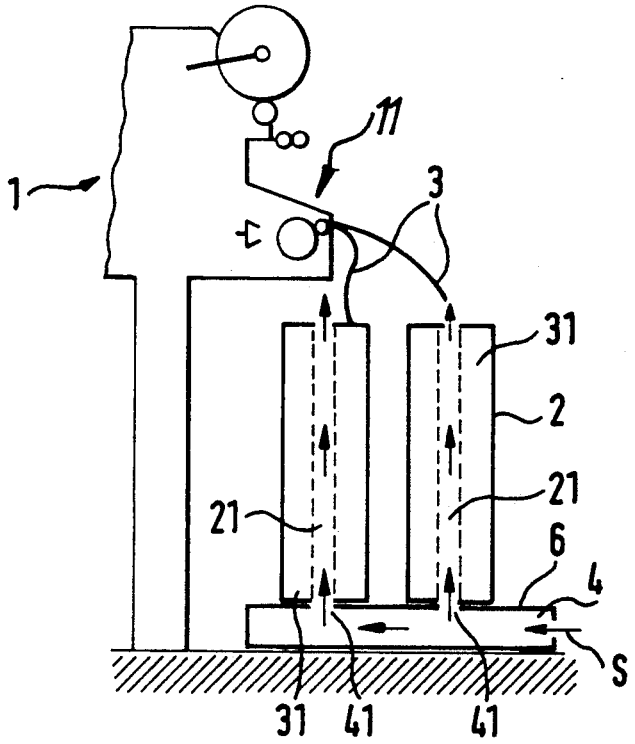
FIG. 1 is a diagrammatic side view, showing the air-conditioning of spinning material in an open top container.

FIG. 1 shows one half of the two-sided open-end rotor spinning machine 1 on which a rotor as well as a winding device are shown in a basic sketch. A fiber sliver 3, stored in a can 2 is drawn into this spinning machine. THe fiber sliver 3, which is used as the spinning material, is deposited in the can 2 in cycloid form. This produces an air space 21 in the can 2 which is surrounded by the stored fiber material 31.

In FIG. 1 the cans 2 are deposited on an air-conditioning duct. Openings, through which a fluid flows, are provided in the floor of the can, as well as in the tray on which the fiber material 31 lies. A fluid flows through the air-conditioning channel 4 in direction of flow S. The fluid has an optimal climate, from the point of view of temperature and humidity, for the further processing of the fiber sliver 3. The fluid brushes along the fiber sliver 3 in the air space 21, causing a temperature and humidity exchange between the fiber sliver 3 and the fluid. This exchange continues until the fiber sliver 3 is in equilibrium with the fluid flowing through with respect to temperature and humidity. Gradual adaptation of the fiber sliver 3 to an climatic state which is optimal for the further processing of the fiber sliver 3 concerned, is thus achieved. The adaptation to the optimal state continues all the better up to the point of saturation the longer the fluid acts upon the fiber sliver 3. This process is, therefore, especially well suitable with spinning machines in which the spinning material can be exposed for a sufficiently long time to the influence of the air-conditioned fluid.

Figure 7:
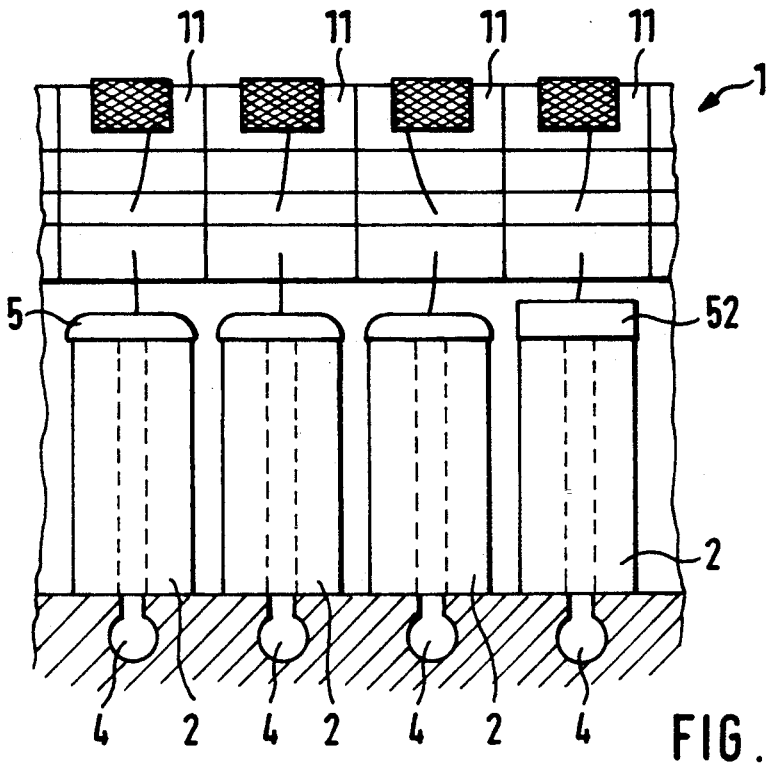
FIG. 7 is a diagrammatic front view, showing the air-conditioning of spinning material at several spinning stations of as pinning machine.

The invention produces the advantage that the cans 2 can be placed in a spinning hall having any climate and that the spinning material can be processed in an optimal air-conditioned state. The instant invention makes it possible to process different qualities of spinning material in a spinning machine with a plurality of processing stations. The spinning materials which are delivered in different climatic states are subjected to different climates, causing them to be in the same climatic state at the time of being processed. It is also possible to produce different qualities in one spinning machine with a plurality of processing stations by means of the instant invention. With spinning machines 1 having a plurality of spinning stations 11 (as seen in FIG. 7), different yarn numbers are produced from identical spinning materials. Different climatic conditions of the spinning material are optimal for different yarn numbers. It is possible to produce different climatic conditions by means of the instant invention for the spinning material to be processed by supplying a spinning machine 1 fluid from several air-conditioning ducts 4 which are independent of each other.

Figure 2:
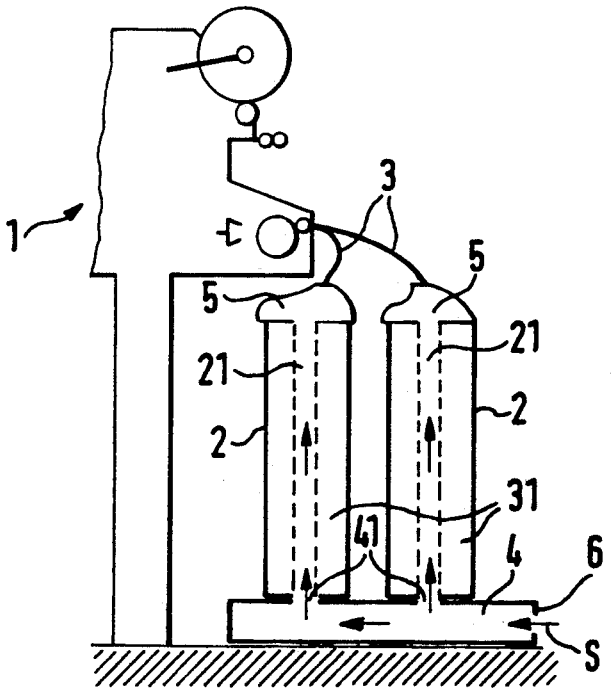
FIG. 2 is a diagrammatic side view, showing the air-conditioning of spinning-material in an essentially closed container.

FIG. 2 shows the device according to FIG. 1 in a preferred embodiment of the invention in which the cans 2 are provided with a cover 5. This produces the advantage that the air-conditioned fluid introduced into the cans 2 does not escape without resistance. This ensures that the optimal climate acts especially upon the upper layers of the fiber sliver 3 in the can 2 for a sufficient length of time so that the spinning material which is processed next acquires the optimal climatic state of the fluid. The covers 5 in the embodiment of FIG. 2 are plastic hoods which are placed over the individual cans 2. The fiber sliver 3 is led out through an opening in the plastic hood to the processing station on the spinning machine 1. The plastic hood prevents unopposed out-flow of the air-conditioned fluid which has flown in. An air-conditioning zone which is distinctly different from the room climate spreads itself out, under these circumstances, over the upper layers of the fiber slivers 3 in the can 2.

By avoiding unopposed out-flow of the air-conditioned fluid a savings in energy costs is achieved. The air-conditioned fluid acts for a considerably longer period of time on the spinning material, thanks to the opposed fluid out-flow so that more time is available for the temperature and humidity exchange between the fluid and the fiber sliver. The temperature and humidity exchange between the spinning material and the fluid is essentially asymptotic. This means that very rapid adaptation of the climatic state of the spinning material to the approximate climatic state of the fluid takes place in the beginning. As time increases, the adaptation to the actual climatic state of the spinning material to the fluid slows down.

Figure 3:
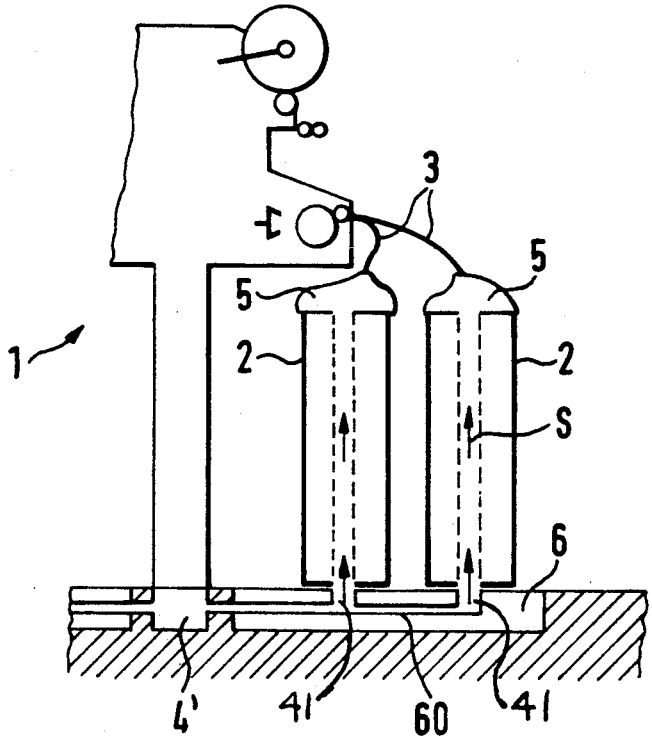
FIG. 3 is a diagrammatic side view, showing the air-conditioning of the containers from one central air-conditioning duct.

FIG. 3 shows a spinning machine 1 with a central air-conditioning duct 4'. The central air-conditioning duct 4' supplies both sides of the two-sided spinning machine with air-conditioned fluid. The constructive effort, as well as the overall quantity of the air-conditioned fluid being used for a spinning machine 1, is reduced by comparison with embodiments of FIGS. 1 and 2, as the overall volume of the duct systems through which the air-conditioned fluid is conveyed is reduced. Here, too, the cans 2 are standing on a platform 6 provided with outlet openings 41 through which the fluid, which is branched off from a central air-conditioning channel 4', is conveyed in ducts 60 to the cans 2 and flows through the latter. The platform 6 in the embodiment shown in FIG. 3 is on the floor level. This results in advantages when feeding the spinning machine 1 from new cans 2, as the cans 2 can be pushed to any station. When air-conditioning is installed on spinning machines after their assembly it is, however, also possible to install platforms 6 on the hall floor, producing a slight rise over the hall floor on which the cans 2 are placed.

Figure 4:
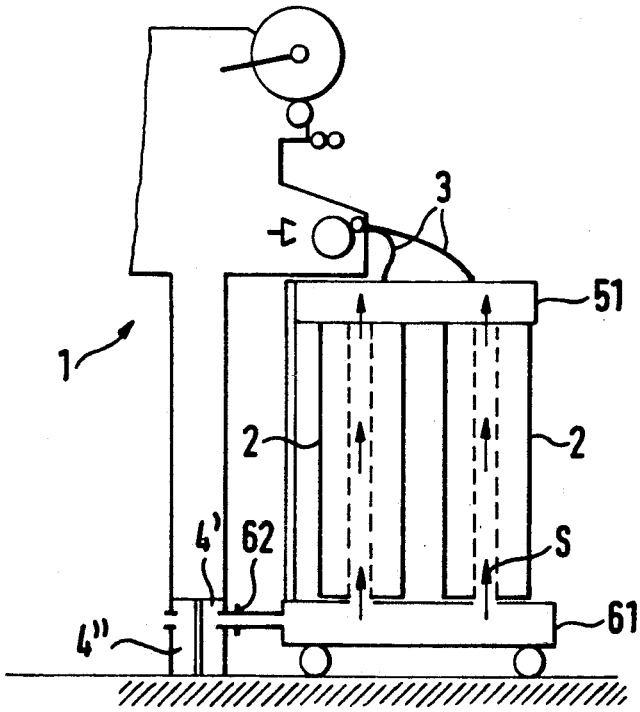
FIG. 4 is a diagrammatic side view, showing the air-conditioning of containers standing on a platform capable of traveling.
Figure 5:
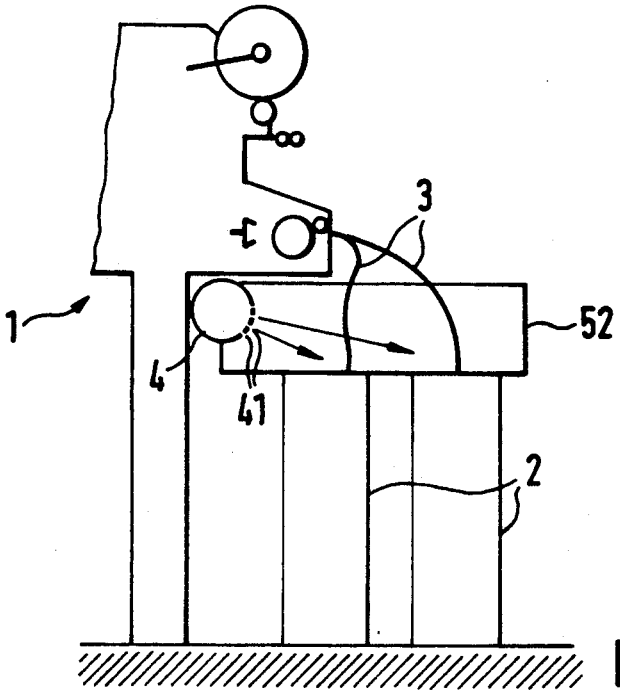
FIG. 5 is a diagrammatic side view, showing the air-conditioning of spinning material according to the counterflow principle.

FIG. 4 shows a spinning machine 1 with central air-conditioning channels 4' and 4''. A traveling platform 61 is connected to the air-conditioning channel 4'. The traveling platform 61 is provided with a cover 51 which extends over two cans 2 in this embodiment. The air-conditioned fluid flows from the central air-conditioning duct 4' through a coupling 62 into the traveling platform 61 and from there into the cans 2. The coupling 62 makes it possible to attach the traveling platform 61 by a flange to the air-conditioning duct 4' following a can replacement. The cans are delivered to the spinning station on the platform 61 and are connected to the air-conditioning duct 4'. The coupling 62 is advantageously provided with a closure which closes the air-conditioning duct 4' at the location of coupling 62 as soon as the platform 61 is removed. Escape of the air-conditioned fluid into the spinning hall is thus avoided.

FIG. 4 shows a central air-conditioning duct 4', 4'' divided in two. This ensures that the spinning machine 1 can be alternately supplied with fluid of two different climates. This makes it possible to obtain optimal air-conditioning for different qualities of alternate spinning materials and/or products to be processed or produced on the machine.

The cover 51 prevents unopposed escape of the fluid. it thus acts for an extended period of time on the upper layers of the fiber sliver 3 in the can 2. The air-conditioned fluid flows out of the cover 51 either through the open underside or through venting openings located on the upper side of the cover 51. The cover 51 is provided on its upper side with openings to take the fiber sliver 3 out of the can 2. The platform 61 is brought either manually to the applicable coupling location 62 of the central or of a non-central air-conditioning duct 4', or it is assigned to its location automatically, for example by automatic means, in the manner of a driver-less conveying system. It is, of course, also possible to provide one or several cans 2 on the platform 61, depending on the organization of the can replacement or the qualities of the spinning materials to be processed.

While a flow through the cans 2 in the direction of fiber sliver 3 removal is shown in the embodiments of FIGS. 1 to 4, FIG. 5 shows the air-conditioning of the spinning material in a direction opposite to that of its removal. The air-conditioning duct 4 is located above the can 2 on the spinning machine 1. The air-conditioning openings 41 are placed in such manner in the air-conditioning duct 4 that the emerging climate fluid acts upon the upper layers of the fiber sliver 3. Just as cover 51 of FIG. 4, the cover 52 is provided with openings to take out the fiber sliver 3 as well as openings, in an advantageous embodiment, to regulate the climatic fluid exchange under the cover 52. In this embodiment the cover 52 is installed in a stationary position on the air-conditioning duct 4 or on the spinning machine 1. However, an embodiment in which the cover 52 is installed on a can 2 and is coupled to the outlet opening 41 of the air-conditioning duct 4 is also advantageous.

Figure 6:
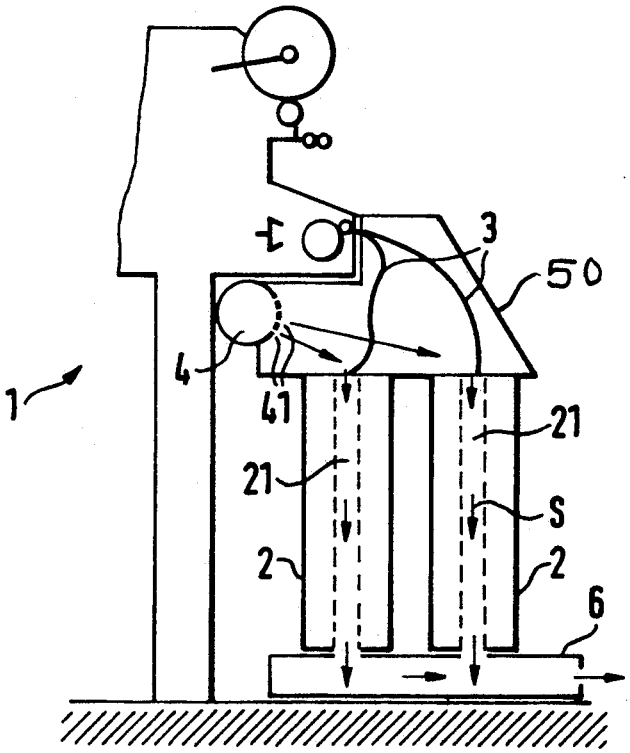
FIG. 6 is a diagrammatic side view, showing the air-conditioning of spinning material according to the counterflow principle.

The embodiment according to FIG. 6 shows spinning cans 2 through which the air-conditioned fluid flows according to the principle of opposite flow. The air-conditioned fluid which flows out of the air-conditioning duct 4 acts first on the upper layers of the fiber sliver 3 in the can 2 and flows through the air space 21 which is constituted in the middle of the can 2. The fluid is guided through the air space 21 and through the floor of the can 2 into a platform 6 through which it flows to the outside. Here, too, an adjustable cover of the flow-off opening in the platform 6 by means of which the flow speed can be influenced is advantageous.

The underside of the cover 50 forms a tight seal with the circumference of the cans 2, e.g. by means of rubber lips. This ensures the intended direction of flow of the fluid through the air stream 21. The replacement of the cans 2 is effected by opening a lateral surface of the cover 50. The cover 50 is designed so that the space between can 2 and the location of continued processing, in this case, an opening roller 11, can be air-conditioned. This ensures that the fiber sliver 3 is exposed to the optimal climate until immediately before being processed, avoiding having the optimal climate being sucked into the spinning machine 1 by the negative pressure prevailing in said spinning machine 1 so that it air-conditions the spinning material only to an insufficient extent.

FIG. 7 shows a frontal view of a spinning machine 1 with spinning stations 11 installed next to each other. Each spinning station is assigned a can 2 which is placed on an air-conditioning duct 4. The cans 2, covered with a cover 52, are traversed independently of each other in this embodiment by an air-conditioned fluid. Each can 2 is covered individually by a cover 52. The cover 52 is in place on cans 2 when the can 2 is being transported, so that a climatic change of the fiber sliver 3 is delayed in comparison with open storage. This makes it possible, for example in a storage area where the filled cans 2 are in intermediate storage, for the fiber sliver to be subjected to an air-conditioned fluid so that the time during which the optimally air-conditioned fluid is able to act upon the fiber sliver 3 is thereby extended. If the can 2 is covered during its transport from the storage area to the point of further processing, the climate which it has been given will be maintained for a longer period of time in the can 2. Furthermore, the fiber sliver 3 which is then first processed is fed to the processing point in a climatic state that is already optimal.

Figure 8:
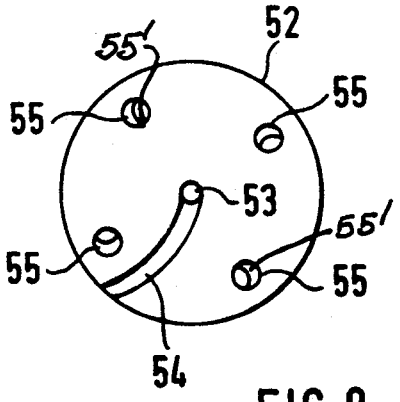
FIG. 8 is a diagrammatic top view which shows a cover of a container.

FIG. 8 shows the cover 52 in a top view. An opening 53 is located in the center of the cover 52, through which the fiber sliver is removed from the can. Starting at the circumference of the cover 52, an oblong slit 54 extends in the direction of opening 53. Removal of the fiber sliver 3 from the can 2 as well as introduction of the fiber sliver 3 into the opening 53 is facilitated by the slit 54. The fiber sliver 3 is here taken out of the can 2 and is threaded into the slit 54. Once the fiber sliver is in the opening 53, the slit 54 is closed. This is done by twisting a disk which is centered with respect to the opening 53, for example. This ensures that the fiber sliver cannot be unthreaded on its own and thus damaged during its removal from the can 2 for further processing. Venting openings 55 are also located on the surface of the cover 52, through which the air-conditioned fluid, introduced into the can 2, escapes. By changing the cross-section of the opening 55 the flowing speed and, thereby, the renewal rate for the fluid are influenced. This is done independently of the speed at which the fiber sliver is taken out and of the difference between the optimal climate and the starting climate. The venting openings 55 can also be sealed by twisting a disk 55' located under the cover 52. FIG. 8 shows the round venting openings 55 about half closed. The venting openings 55 can of course also be located on the side of the cover 52.

Figure 9:
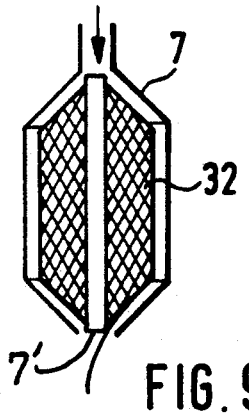
FIG. 9 is a diagrammatic side view, showing the air-conditioning of a condenser bobbin in a container.

FIG. 9 shows a container other than a can. The container 7 surrounds a condenser bobbin on which a fiber roving 32 is wound for ring spinning. The container 7 is traversed by an optimally air-conditioned fluid in the same manner as was can 2. Here, too, the fluid acts upon the fiber roving 32, making it possible to reach a climatic equilibrium. After air-conditioning the fiber roving 32 is fed to the point of further processing. Just as with the fiber sliver 3 in the spinning can 2, the fiber roving 32 in the container 7 is capable of being air-conditioned according to the principle of direction-of-flow or to that of counterflow. Openings 7' for the removal of the fiber sliver as well as vent openings and threading openings can be provided on the container 7, just as shown in FIG. 8.

The instant invention is not limited to the embodiments shown. Combinations of the different embodiments according to the invention are thus, of course, possible. Air-conditioning is, furthermore, not limited to fiber slivers and fiber rovings in spinning machines but can be used for any type of spinning material which can be exposed before processing for a sufficient time to a certain climate in order to obtain a transition to a state of equilibrium with the fluid.

We claim:

1. A device for air conditioning spinning material to prepare it for further processing in a yarn spinning machine, comprising:

a vertically oriented can for holding said spinning material therein in layers, said can having an inlet adjacent the bottom portion thereof, and an outlet adjacent the top portion thereof;

means for air conditioning a climatic fluid to a predetermined climate;

a platform for supporting said can, said platform further comprising at least one opening disposed therein and ducting for conveying said climatic fluid from said air conditioning means to said opening, whereby said can is disposed on said platform so that said inlet of said can and said opening are in fluid communication so that said climatic fluid can pass into said can through said opening and said inlet;

means for regulating the renewal rate of said climatic fluid through said can as a function of a predetermined withdrawal rate of said spinning material from said can, said regulating means allowing for an increase in the renewal rate of said climatic fluid as the withdrawal rate of said spinning material increases; and a spinning material opening in said container to permit withdrawal of said spinning material from said container for further processing in said yarn spinning machine.

2. The device as in claim 1, wherein said regulating means comprises a cover adapted to fit on said can, said cover having at least one vent opening defined therein, said vent opening having a variable cross-section sot hat the renewal rate of said climatic fluid can be varied by changing the cross-sectional area of said vent opening.

3. A process for preparing spinning material for processing in a yarn spinning machine by bringing the spinning material to a predetermined optimal climatic condition before being processed in the yarn spinning machine, comprising the following steps:

disposing said spinning material in layers in a verticlaly extending can having a fluid inlet adjacent a bottom portion thereof and a fluid outlet adjacent a top portion thereof;

placing said container upon a platform having at least one opening disposed therein so that said fluid inlet adjacent said bottom portion of said can and said opening of said platform are in fluid communication;

determining the optimal climatic condition for said spinning material, said optimal climatic condition being dependent upon the type of said spinning material being used and the quality of yarn to be drawn therefrom;

air conditioning a climatic fluid to bring said fluid to at least said predetermined optimal climatic condition determined for said spinning material;

passing said climatic fluid through said platform so that said climatic fluid enters the can through said opening and said fluid inlet;

regulating the renewal rate of said climatic fluid in said can as a function of the predetermined withdrawal rate of said spinning material from said can whereby the renewal rate of said climatic fluid is increased as withdrawal rate of said spinning material is increased so that said spinning material is sufficiently exposed to said climatic fluid so as to achieve said predetermined optimal climatic condition; and withdrawing said spinning material from said contaienr after said spinning material has reached said predetermined optimal climatic condition for further processing by said spinning machine.

4. The process as in claim 3, further including maintaining said spinning material within said can and exposed to said climatic fluid for a predetermined time period prior to withdrawal thereof so that an equilibrium condition is established between said climatic fluid and said spinning material, and whereby said regulating the renewal rate of said climatic fluid maintains said equilibrium condition.

5. A process for preparing spinning material for processing in a yarn spinning material by brining the spinning material to a predetermined optimal climatic condition before being processed in the yarn spinning machine, comprising the following steps:

disposing said spinning material in layers in a vertically extending can having a fluid inlet adjacent a bottom portion thereof and a fluid outlet adjacent a top portion thereof;

placing said container upon a platform having at least one opening disposed therein so that said fluid inlet adjacent said bottom portion of said can and said opening of said platform are in fluid communication;

determining an optimal climatic condition for said spinning material, said optimal climatic condition being dependent upon the type of said spinning material being used and the quality of yarn to be drawn therefrom;

determining the actual climatic condition of said spinning material;

air conditioning a climatic fluid to bring said fluid to at least said predetermined optimal climatic condition determined for said spinning material;

passing said climatic fluid through said platform so that said climatic fluid enters the can through said opening and said fluid inlet;

regulating the renewal rate of said climatic fluid in said can as a function of the difference between said predetermined optimal climatic condition and said actual climatic condition of said spinning material, whereby the renewal rate of said climatic fluid is increased as the difference between said optimal climatic condition and said actual climatic condition increases; and withdrawing said spinning material from said container after said spinning material has reached said predetermined optimal climatic condition for further processing by said spinning machine.

* * * * *